United States Patent [19]

Merritt

[11] 4,160,286

[45] Jul. 3, 1979

[54] LUMINAIRE SHIELD

[75] Inventor: William H. Merritt, Seattle, Wash.

[73] Assignee: Plastics Engineering & Manufacturing Co., Seattle, Wash.

[21] Appl. No.: 816,451

[22] Filed: Jul. 18, 1977

[51] Int. Cl.[2] ..... F21V 13/02; F21V 3/02; F21V 3/04

[52] U.S. Cl. ..... 362/311; 362/255; 362/256; 362/307; 362/329; 362/363; 362/376; 362/431; 362/457

[58] Field of Search ..... 362/255, 256, 307, 311, 362/329, 363, 376, 431

[56] References Cited

U.S. PATENT DOCUMENTS

| | | | |
|---|---|---|---|
| 1,978,236 | 10/1934 | Tuck | 362/431 |
| 2,662,165 | 12/1953 | Franck | 362/311 X |
| 3,024,356 | 3/1962 | Florence | 362/363 |
| 3,315,072 | 4/1967 | Harling | 362/329 |
| 3,366,787 | 1/1968 | Kelley | 362/311 |

*Primary Examiner*—Richard D. Lovering
*Attorney, Agent, or Firm*—Robert W. Beach; Ward Brown

[57] ABSTRACT

A transparent hemispherical shield formed of polycarbonate resin protects a light-diffusing lens mounted in an aperture in the door of a conventional streetlight. The shield has an inwardly projecting flange disposed in a diametral plane and defining an aperture of approximately the same size and shape as the door aperture. The shield is attached to the streetlight by resilient return-bent clips having spaced parallel tabs securing the shield flange to the streetlight door.

11 Claims, 5 Drawing Figures

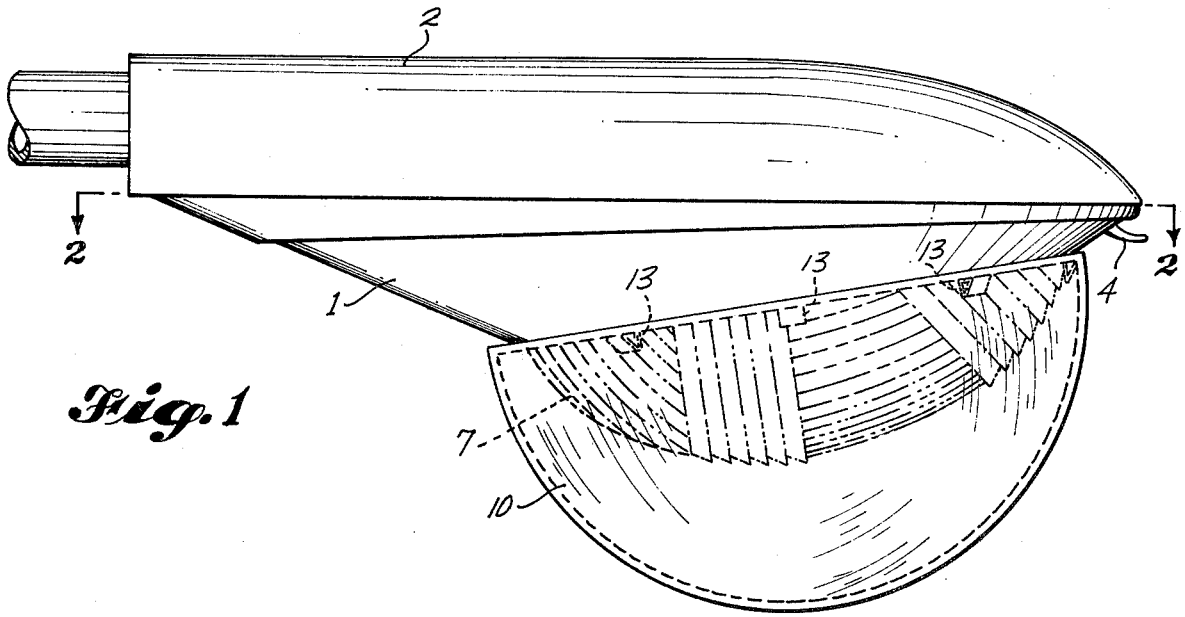
Fig. 1
Fig. 2
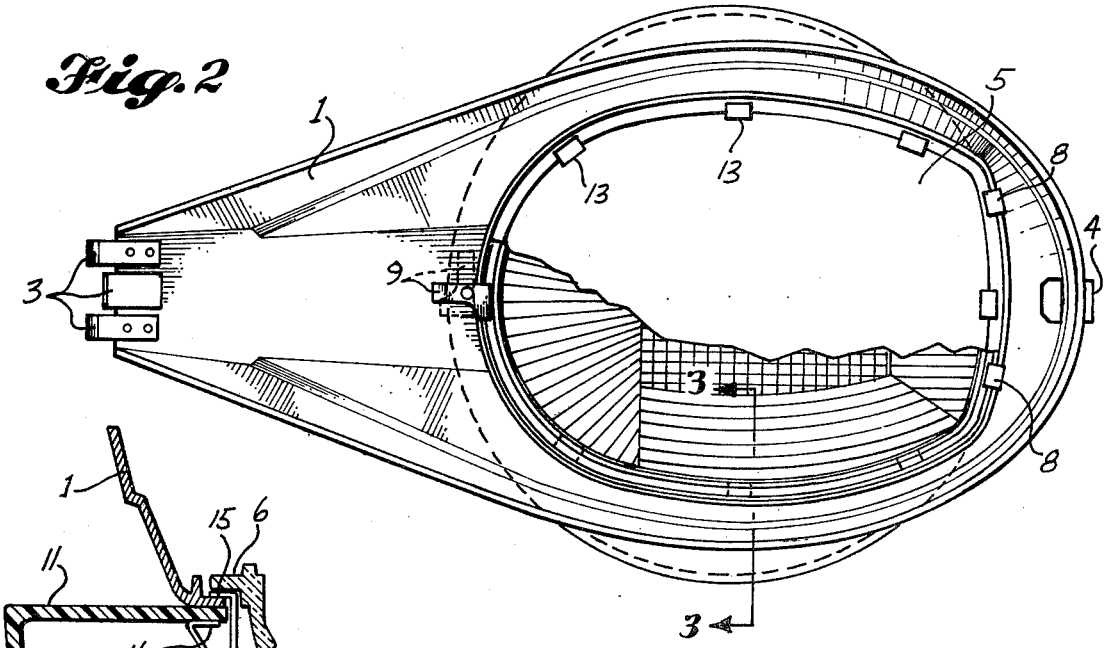
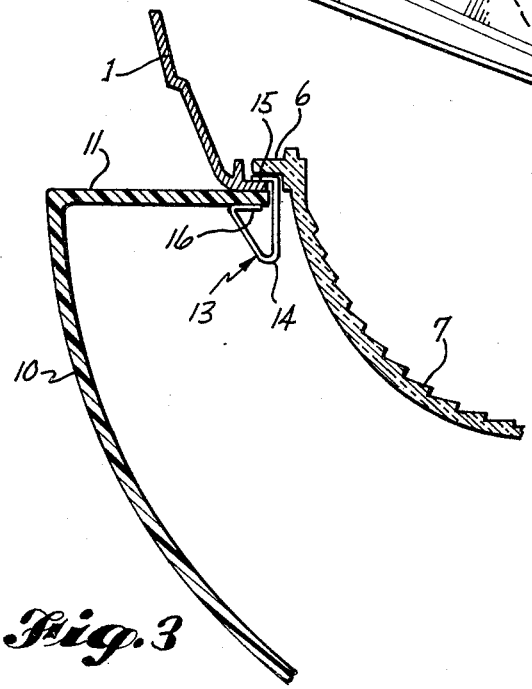
Fig. 3
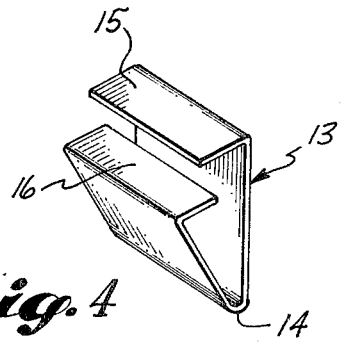
Fig. 4

LUMINAIRE SHIELD

BACKGROUND OF THE INVENTION

1. Field of the Invention

The present invention relates to shields for the light-diffusing lenses of luminaires.

2. Prior Art

Lenses are often provided to diffuse light from the light-producing means of a luminaire and to cover such light-producing means. Conventionally, light-diffusing lenses are made of glass and, hence, are subject to vandalism breakage. Such breakage necessitates frequent replacement of light-diffusing lenses and also subjects persons in the area of the luminaire to injury due to broken glass.

Light-diffusing lenses have been made of a synthetic such as polycarbonate resin which has greater impact resistance and, consequently, is less subject to breakage than glass. However, forming an impact resistant synthetic into the complex shape and structure required to diffuse light into a desired pattern is expensive. In addition, there has been a trend toward use of higher output light sources, particularly in outside luminaires such as streetlights. Such higher output light sources produce more heat and ultraviolet radiation which can discolor and even deform synthetic lenses, especially when the lenses are located close to the luminaire light-producing means where such lenses are most effective to diffuse light. Thus, exotic and expensive synthetics have been used to form light-diffusing lenses having high impact strength, heat resistance and dimensional stability. Even lenses formed of such exotic synthetics will become discolored if left in place for an extended period.

SUMMARY OF THE INVENTION

It is an object of the present invention to provide a transparent protective cover for the light-diffusing lens of a luminaire.

Another object is to provide such a cover which will not significantly reduce the amount of light emitted by the luminaire.

It is also an object to provide such a cover which is of a material and shape which will effectively protect the light-diffusing lens of a luminaire from rocks thrown and even bullets shot, over an extended period, without becoming discolored or deformed.

A further object is to provide such a cover in a form which is simple to install on conventional streetlights.

The foregoing objects can be accomplished by providing a shield formed of a clear impact resistant synthetic. In the preferred embodiment of the invention, the shield is hemispherical and includes an inwardly projecting flange disposed in a diametral plane which flange defines an aperture of approximately the same size and shape as the lens-covered aperture in the door of a conventional streetlight. The shield is attached to such streetlight by resilient returnbent clips having spaced parallel tabs securing the shield flange to the streetlight door.

BRIEF DESCRIPTION OF THE DRAWINGS

FIG. 1 is a side elevation of a streetlight having a shield in accordance with the present invention.

FIG. 2 is a section taken on line 2—2 of FIG. 1, and FIG. 3 is an enlarged section taken on line 3—3 of FIG. 2 with parts broken away.

FIG. 4 is a top perspective of a shield-mounting clip in accordance with the present invention.

DETAILED DESCRIPTION

Figure 5:
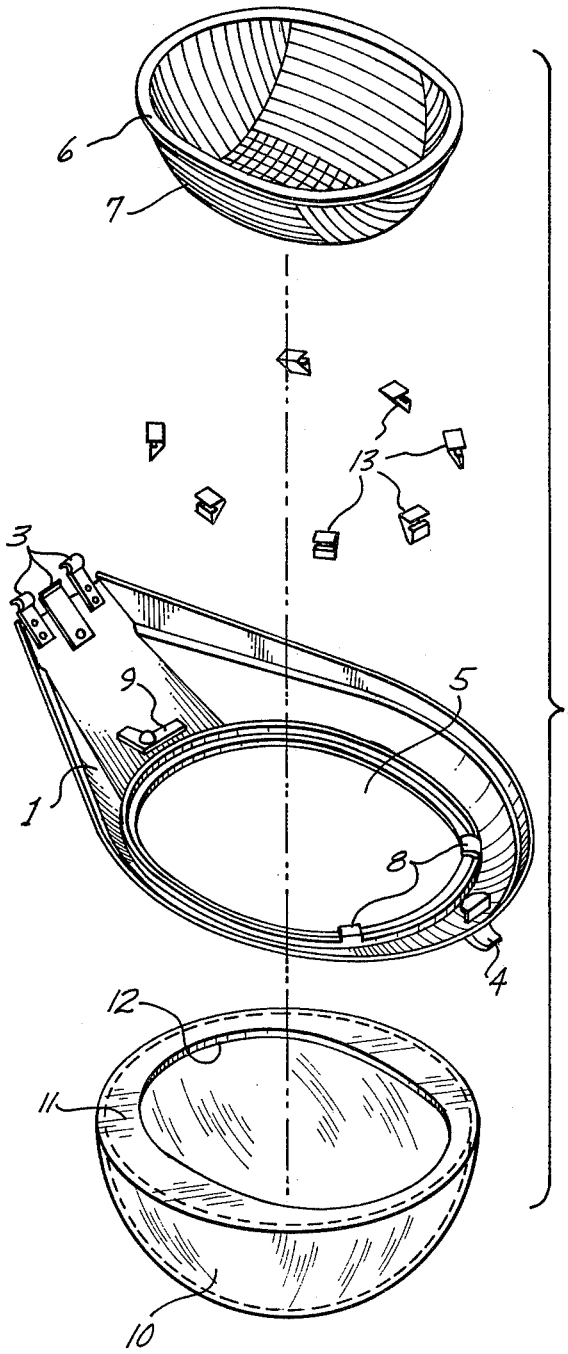
FIG. 5 is an exploded top perspective of a conventional streetlight door and light-diffusing lens, a shield and shield-mounting clips in accordance with the present invention.

In a conventional streetlight a door 1 is removably connected to a frame 2 by hinge brackets 3 and a latch 4. The door includes an elongated aperture 5, the upper margin of which is contacted by the external flange 6 of a light-diffusing lens 7. Upward movement of the lens flange is limited by overhanging lugs 8 at one end of the lens and a pivoted latch finger 9 at the other end of the lens.

According to the present invention a transparent hemispherical shield 10 is provided to protect the light-diffusing lens of the streetlight. Such shield should be made of a material which has high impact strength, heat resistance and dimensional stability. Polycarbonate resin of a thickness of 0.10 inch (2.54 mm) to 0.16 inch (4.06 mm), preferably 0.14 inch (3.56 mm), has been found to be a satisfactory shield material and can be molded in a hemispherical shape. A hemispherical shape is preferred because it is structurally stronger than other possible shapes and is the most effective shape for deflecting rocks and bullets that may strike the cover to reduce their tendency to penetrate the cover. Moreover, polycarbonate resin sheet material does not shatter even when pierced. The hemispherical shield is of such a size as to be spaced a substantial distance, preferably at least 1 inch (25.4 mm), from the light-diffusing lens of the streetlight so that there is less chance of the shield being discolored or deformed by heat or ultraviolet radiation.

Shield 10 has an inwardly projecting diametral flange 11 to space the body of the shield from the lens and to compensate for the differences in shape of the elongated lens body and the hemispherical shape of the shield. The flange can be formed integrally with the hemispherical shield shell, or can be cut from a flat sheet and bonded to the shell by heat sealing, solvent sealing or gluing. As best seen in FIG. 5, the inner perimeter of the flange 11 defines an aperture 12 of approximately the same size and shape as the door aperture 5. The shield flange 11 is held against the margin of the streetlight door aperture 12 by resilient clips 13 which can be located at desired positions around the margin of the door aperture. As best seen in FIG. 3, each clip is made of strip material including a return-bent body forming a handle in the shape of a downwardly projecting wedge having an acute angle bend 14 below flange 11. A tab 15 projects outward from the upper end of the body 14 to engage the upper margin of the door aperture and a lower tab 16, spaced from and parallel to the door-engaging tab, projects inward from the other end of the body to engage the lower margin of the shield flange aperture.

To install the shield 10, the door 1 of a streetlight is removed from the streetlight frame 2 and its light-diffusing lens 7 is released by swiveling the lens latch 9 from the position shown in full lines in FIG. 2 to the position shown in broken lines in that figure and in FIG. 5. The lens is then removed from the door and shield 10 is positioned with the margin of its flange 11 engaging the underside of the door and the flange aperture 12 in registration with the door aperture 5. Clips 13 are slid into position with their upper and lower tabs 15 and 16 securing the shield to the door. Lens 7 is then returned into the door aperture with its external flange 6 resting on the upper sides of the clip door-engaging tabs 15 and is locked into position by turning latch 9 back to the solid line position of FIG. 2. As best seen in FIG. 3, the portion of the lens 7 which projects through the door aperture 5 prevents inward sliding movement of the clips so that the shield is held snugly in position and cannot be released without removing the lens. The door is then resecured in the streetlight frame.

Installation of the shield is simple and fast and requires no special tools. The installed shield effectively protects the streetlight lens over an extended period without becoming discolored or deformed. Even if the shield is penetrated by a projectile, the shield will not be shattered but will retain its integrity except for the aperture through which the projectile passed. If the glass lens is shattered the intact shield will catch and retain the lens fragments to prevent them from falling and possibly causing injury.

I claim:

1. In a luminaire including a frame, a door connected to the frame, a light-diffusing lens mounted in an aperture in the door and light-producing means enclosed by the frame, door and lens, the improvement comprising a transparent shell at the side of the lens opposite the light-producing means for protecting the lens, a flange projecting inward from the margin of said shell, and means for securing said flange to the luminaire door.

2. In the luminaire defined in claim 1, the securing means being a plurality of clips each including a return-bent body.

3. In the luminaire defined in 2, one end portion of each clip body forming a door-eng tab and the other end portion of such clip body forming flange-engaging tab spaced from and parallel to said door engaging tab, the remainder of the clip body forming a handle projecting generally lateral from said tabs.

4. In the luminaire defined in claim 1, the shield being polycarbonate resin of a thickness of 0.10 inch (2.54 mm) to 0.16 inch (4.06 mm).

5. In the luminaire defined in claim 1, the adjacent surfaces of the shell and the lens being spaced apart at least one inch (2.54 cm.).

6. In the luminaire defined in claim 1, the inner perimeter of the flange defining an aperture of approximately the same size and shape as the aperture in the luminaire door.

7. In a luminaire including a frame, a door connected to the frame, a light-diffusing lens mounted in an aperture in the door and light-producing means enclosed by the frame, door and lens, the improvement comprising a transparent shell for protecting the lens, said shell being of hemispherical shape, disposed at the side of the lens opposite the light-producing means and spaced from the lens, and means for securing said shell to the luminaire door.

8. In the luminaire defined in claim 7, a flange projecting inward from the margin of the shell and located in a diametral plane of the shell, the inner perimeter of such flange defining an aperture of approximately the same size and shape as the aperture in the luminaire door.

9. In the luminaire defined in claim 7, the shell being spaced at least one inch (2.54 cm.) from the lens.

10. In the luminaire defined in claim 7, the shell being polycarbonate resin of a thickness of 0.10 inch (2.54 mm.) to 0.16 inch (4.06 mm.).

11. In a streetlight including a frame, a door connected to the frame, a light-diffusing lens carried in an aperture in the door and light-producing means enclosed by the frame, door and lens, the improvement comprising a transparent hemispherical polycarbonate shield of a thickness of 0.10 inch (2.54 mm) to 0.16 inch (4.06 mm) which shield is at the side of the light-diffusing lens opposite the light-producing means and is spaced from such lens, said shield having an inwardly projecting diametral flange the inner perimeter of which flange defines an aperture of approximately the same size and shape as the aperture in the streetlight door, and a plurality of clips securing said flange to the door, each of said clips including a return-bent body forming a downwardly projecting handle, a door-engaging tab on one end of said body and a flange-engaging tab on the other end of said body spaced from and parallel to said door-engaging tab.

* * * * *

UNITED STATES PATENT AND TRADEMARK OFFICE

CERTIFICATE OF CORRECTION

PATENT NO. : 4,160,286

DATED : July 3, 1979

INVENTOR(S) : William H. Merritt

It is certified that error appears in the above-identified patent and that said Letters Patent are hereby corrected as shown below:

Column 3, line 37, (claim 3, line 1) before "2" insert --claim--; line 38, (claim 3, line 2) cancel "door-eng" and insert --door-engaging--; line 39, (claim 3, line 3) after "forming" insert --a--; line 40, (claim 3, line 4) after "door" insert a hyphen; line 42, (claim 3, line 6) cancel "lateral" and insert --laterally--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*